US012416057B2

(12) United States Patent
Balun et al.

(10) Patent No.: US 12,416,057 B2
(45) **Date of Patent: *Sep. 16, 2025**

(54) TUBE PRODUCT, HOLLOW CARRIER OF PERFORATING GUN AND METHOD OF MANUFACTURING THE TUBE PRODUCT

(71) Applicant: Benteler Steel/Tube GmbH, Paderborn (DE)

(72) Inventors: Jozef Balun, Schlangen (DE); Waldemar Engel, Paderborn (DE); Niko Große-Heilmann, Harsewinkel (DE); Michael Kaufmann, Paderborn (DE); Nathalie Weiß-Borkowski, Büren-Brenken (DE)

(73) Assignee: Benteler Steel/Tube GmbH (DE)

( * ) Notice: Subject to any disclaimer, the term of this patent is extended or adjusted under 35 U.S.C. 154(b) by 407 days.

This patent is subject to a terminal disclaimer.

(21) Appl. No.: 16/722,510

(22) Filed: Dec. 20, 2019

(65) Prior Publication Data

US 2021/0189516 A1 Jun. 24, 2021

(51) Int. Cl.
*C21D 9/08* (2006.01)
*C21D 1/18* (2006.01)
(Continued)

(52) U.S. Cl.
CPC ..... *C21D 9/085* (2013.01); *C21D 1/18* (2013.01); *C21D 6/002* (2013.01); *C21D 6/005* (2013.01);
(Continued)

(58) Field of Classification Search
CPC ..... C21D 9/085; C21D 1/18; C21D 6/002; C21D 6/005; C21D 6/008;
(Continued)

(56) References Cited

U.S. PATENT DOCUMENTS 3,366,471 A * 1/1968 Matas ..... C22C 38/105 420/92
2005/0034790 A1 2/2005 Kaufmann et al.
(Continued)

FOREIGN PATENT DOCUMENTS

CN 107354375 A 11/2017
CN 108474080 A 8/2018
(Continued)

OTHER PUBLICATIONS

G. J. Roe, B. L. Bramfitt, Notch Toughness of Steels, 1990, ASM Handbook Committee, ASM International, Properties and Selection: Irons, Steels, and High-Performance Alloys, vol. 1, ASM Handbook, pp. 737-754 (Year: 1990).*

*Primary Examiner* — Jonathan Johnson
*Assistant Examiner* — Maxwell Xavier Duffy
(74) *Attorney, Agent, or Firm* — Pandiscio & Pandiscio

(57) ABSTRACT

The present invention relates to a tube product, namely a perforating gun hollow carrier, consisting of a steel alloy with martensitic matrix, characterized in that it has a yield strength Rp0, 2 of at least 900 MPa, and that the steel alloy besides iron and impurities caused by melting has the following alloying elements: C 0.15-0.6%; Si 1.4-2.6%; Cr 2.0-4.0%; Mn 0.15-2.0%; Mo 0.2-0.6%; N<0.015%; and at least one of the alloying elements Nb, V and Ti in sum of ≥0.01% and the tube product has been subjected to a quenching and partitioning heat treatment. Furthermore, the invention relates to a method of manufacturing such a tube product.

18 Claims, 4 Drawing Sheets

(51) Int. Cl.

| | |
|---|---|
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |

(52) U.S. Cl.
CPC ..... *C21D 6/008* (2013.01); *C22C 38/001* (2013.01); *C22C 38/02* (2013.01); *C22C 38/04* (2013.01); *C22C 38/22* (2013.01); *C22C 38/24* (2013.01); *C22C 38/26* (2013.01); *C22C 38/28* (2013.01); *C21D 2211/001* (2013.01); *C21D 2211/008* (2013.01)

(58) Field of Classification Search
CPC ..... C21D 2211/001; C21D 2211/008; C22C 38/001; C22C 38/02; C22C 38/04; C22C 38/22; C22C 38/24; C22C 38/26; C22C 38/28
See application file for complete search history.

(56) References Cited

U.S. PATENT DOCUMENTS

| | | | | |
|---|---|---|---|---|
| 2005/0217842 | A1* | 10/2005 | Kash | E21B 43/117 166/55.2 |
| 2006/0070687 | A1 | 4/2006 | Miyata et al. | |
| 2013/0048161 | A1* | 2/2013 | Matsuda | C21D 1/22 148/333 |
| 2017/0081948 | A1* | 3/2017 | Balun | E21B 43/116 |
| 2017/0314116 | A1* | 11/2017 | Kawata | C21D 8/0473 |
| 2017/0321294 | A1* | 11/2017 | Arlazarov | C22C 38/32 |
| 2017/0341619 | A1 | 11/2017 | Tegethoff et al. | |
| 2018/0179865 | A1* | 6/2018 | Balun | F42D 1/02 |
| 2020/0255926 | A1 | 8/2020 | Grosse-Heilmann et al. | |

FOREIGN PATENT DOCUMENTS

| | | | | |
|---|---|---|---|---|
| DE | 699 28 635 | | 7/2006 | |
| DE | 10 2018 106 546 | | 9/2019 | |
| EP | 1 983 065 | | 11/2014 | |
| JP | 4317384 | B2 * | 8/2009 | |
| JP | 2010280962 | A | 12/2010 | |
| WO | WO 2013/004910 | | 1/2013 | |
| WO | WO-2013004910 | A1 * | 1/2013 | C21D 1/18 |
| WO | WO 2017/085135 | | 5/2017 | |

* cited by examiner

TUBE PRODUCT, HOLLOW CARRIER OF PERFORATING GUN AND METHOD OF MANUFACTURING THE TUBE PRODUCT

FIELD OF THE INVENTION

The present invention relates to a tube product, namely a hollow carrier of a perforating gun and a method of manufacturing such a tube product.

BACKGROUND OF THE INVENTION

Perforating Guns are used for activating boreholes for crude oil and natural gas exploitation. Therein, the rock surrounding the borehole is destroyed by means of a targeted detonation, to make the rock more permeable for the fluid, that means the crude oil or natural gas. The surrounding hollow support, which is hereinafter also referred to as hollow carrier, has the task of holding the perforating gun during detonation and must not be destroyed or considerably deformed to avoid clogging of the borehole. This requires a high resistance of the hollow carrier material against highly dynamic load.

SUMMARY OF THE INVENTION

It is thus the task of the present invention to provide a tube product, namely a perforating gun hollow carrier, which reliably can satisfy the requirements of the tube product. In addition, a method of manufacturing this tube product should be provided.

The task is being solved by the tube product with the features of claim 1. Preferred embodiments can be derived from the dependent claims, the description and the figures.

Accordingly, the invention relates to a tube product, namely a perforating gun hollow carrier, consisting of a steel alloy with martensitic matrix. The tube product is characterized in that it has a yield strength Rp0.2 of at least 900 MPa, and that the steel alloy besides iron and impurities caused by melting has the following alloying elements:

C 0.15-0.6%
Si 1.4-2.6%
Cr 2.0-4.0%
Mn 0.15-2.0%
Mo 0.2-0.6%
N<0.015% and
at least one of the alloying elements Nb, V and Ti in sum of ≥0.01% and
the tube product has been subjected to a quenching and partitioning heat treatment.

The tube product is a part of a perforating gun, which will hereinafter also be referred to as PerfGun. In particular, the tube product is the hollow support, which will hereinafter be referred to as hollow carrier.

The tube product, namely the hollow carrier can have several, in particular locally limited, sections of reduced wall thickness. These locally limited sections are preferably punctual or circular sections. The sections are provided in the hollow carrier in order to form wall openings at the hollow carrier upon ignition of ignition charges inserted into the hollow carrier. Due to the high energy absorption capacity of the inventive steel alloy, of which the hollow carrier consists, it can be ensured at ignition of the ignition charges that the hollow carrier does not burst. Only the sections of reduced wall thickness are perforated and thereby the perforation of the surrounding rock becomes possible.

The steel alloy will hereinafter also be referred to as alloy, steel or material. Content indications of alloying elements are provided in mass percent but are possibly simply indicated as percent.

Carbon (C) is necessary for generating the martensitic micro structure, which preferably has portions of austenite. According to the invention, carbon is added in an amount of at least 0.15%. It became apparent that with a carbon content of less than 0.15% not sufficient carbon is present in the steel to achieve a significant stabilization of austenite, which can also be referred to as retained austenite stabilization. However, the carbon content is limited according to the invention to a maximum of 0.6%. Preferably, the carbon content in the alloy is in a range between 0.15-0.5% and further preferably in a range between 0.15 and 0.3%.

According to the invention the steel alloy has a silicon (Si) content in the range from 1.4-2.6%. Silicon can be used as deoxidizing agent due to its high oxygen affinity. Therefore, silicon is mostly present in killed steel alloys. Due to the presence of silicon in the indicated amounts, a carbide formation can be prevented, so that carbon is available for stabilizing the retained austenite.

Preferably, silicon is present in an amount in the range from 1.7 to 2.4% and particularly preferred in an amount in the range from 1.8 to 2.2%.

According to the invention, chromium (Cr) is present in a range from 2 to 4%. Preferably, chromium is present in an amount in the range from 2.5 to 3.5% and particularly preferably in an amount in the range from 2.8 to 3.2%. By adding chromium in these amounts, chromium can serve as a carbide forming element. By adding carbide forming elements to iron-carbon alloys, an area free of transitions exists at temperatures above the starting temperature of the intermediate micro structure Bainite, which is also referred to as Bs (bainite start temperature). In the time-temperature-transition diagram this is visible as a complete separation of the transition areas for ferrite/perlite and bainite. This area, where no transitions occurs, is also internationally referred to as bay. It has proven that both the undesired bainite formation as well as the cementite formation is impeded at these temperatures, if carbide forming elements are added to the alloy.

According to the invention, the steel alloy has a manganese (Mn) content of less than 2%, preferably, less than 1.5% and further preferably less than 0.7%. Simultaneously, manganese is present in an amount of at least 0.15% and preferably 0.4%. By adding manganese, the through-hardenability of the steel alloy can be increased. In addition, the martensite-start-temperature (Ms) is significantly lowered by the addition of manganese. If manganese is present at a too high amount, undesired segregations will form.

Molybdenum (Mo) is present in the steel alloy in an amount in the range from 0.2 to 0.6%. By adding molybdenum, temper brittleness can be decreased.

Nitrogen (N) is present in the alloy in a small amount of less than 0.015%, preferably in an amount in the range from 0.0005 to 0.012%. Nitrogen can get into the alloy during the steel production, for example during purging. The nitrogen content in the alloy can be lowered by means of vacuum de-gassing during the production. Thereby, for example, an amount of 0.0005% can be realized.

In addition, the steel alloy contains at least one alloying element for reduction of hydrogen brittlement tendency. In particular, the steel alloy contains at least one of the alloying elements niobium (Nb), vanadium (V), molybdenum (Mo) and titanium (Ti). For example, both niobium as well as vanadium can be added to the steel alloy. In this case the sum of the content of niobium and vanadium (Nb+V) amounts to a maximum of 0.5%. Preferably, however, only one of these two alloying elements (Nb, V) is added to the alloy. The sum of Nb, V and Al is preferably at least 0.01%.

Niobium (Nb) already acts during the production of the hot tube, from which the tube product is preferably manufactured, as carbide forming element and thus causes a fine grain of the micro structure of the tube product and thereby increases the notch impact strength. According to the invention, niobium can be present in an amount in the range from 0.001 to 0.1%, preferably 0.015 to 0.05%.

Vanadium (V) is preferably added in an amount in the range from 0.025 to 0.5%. Vanadium also serves for forming a fine grained micro structure and improves the notch impact strength by forming nitrides and/or nitrocarbides during the Q&P heat treatment. Therefore, vanadium is preferably added in an amount, which corresponds to the requirement V=3.64*N to 5*N.

Titanium (Ti) binds the nitrogen, which is contained in the alloy. Thereby, a formation of harmful boron nitrides can be avoided. By boron nitrides, a through hardenabilty would not be given anymore. Titanium can be present in an amount in the range from 0.015 to 0.1%.

In addition, aluminum (Al) can be present in an amount in the range from 0.01 to 0.1%, preferably in the range from 0.015 to 0.06%.

Optionally, the steel alloy can contain boron (B) . In this case, the amount of boron is in the range from 0.001 to 0.004%. It has proven, that boron lowers the critical quenching rate for martensite. Thereby, the required micro structure can be achieved reliably. If no or not sufficient boron is added to the alloy, austenite decomposition during the heat treatment, in particular the quenching and partitioning (Q&P), can occur, whereby mainly bainite would be formed before partitioning started.

According to the invention, the tube product is a tube product, which has been subjected to a quenching and partitioning heat treatment during the manufacturing.

As the tube product is made from the novel alloy and in addition has been subjected to a Q&P heat treatment, the tube product has a high strength and simultaneously has both an increased resistance against adiabatic shearing as well as very high notch impact values.

In particular, with the invention an increase of the resistance of the alloy and thereby of the tube product against highly dynamic load, in particular the explosion, can be achieved. The classical material sided failure mechanism of a PerfGun, which is referred to as adiabatic shearing, can be prevented. The tube product according to the invention besides a high resistance against adiabatic shearing has a high strength, which is high enough to withstand the ambient pressure of the PerfGun before the explosion. In addition, it has proven that with the present invention a high notch impact energy can be achieved and thereby splintering of the hollow carrier can be prevented.

Adiabatic shearing or shear failure in particular denotes a material failure, wherein during forming forming localizations, that means concentration of the forming, occur and thereby a formation of so called shear bands, which are the initial point for the failure. The adiabatic shear failure in particular occurs at high load velocity.

Preferably, the tube product has a microstructure of martensite and retained austenite, wherein the portion of retained austenite is within the range from 5 to 20% and preferably less than 15%.

Particularly preferably, the amount of austenite in the micro structure, determined in 1 mm depth, measured from the tube outer surface is more than 5%, in particular at least 10%. The austenite portion has a degressively increasing course over the thickness of the tube wall as well as in a distance from the tube outer surface a distinct, nearly constant austenite portion, so that according to the invention preferably overall a low scattering of the yield strength, breaking elongation, notch impact strength is noted.

Preferably, the micro structure has bainite, ferrite and/or perlite in an overall amount of less than 10%, preferably less than 5%, in particular at least 3%.

Preferably, the tube product has an energy absorption capacity expressed by the product of tensile strength, Rm, and breaking elongation, A, of at least 18.000 MPa %. The energy absorption capacity is preferably limited to 45.000 MPa %. The breaking elongation is determined at a round sample with an elongation measurement length of 20 mm.

According to one embodiment, the tube product has a notch impact strength of at least 4 J at 20° C. The notch impact strength is determined for the tube product on a mini sample with a cross sectional area of 3×4 mm.

According to the invention, the steel alloy has a silicon (Si) content in the range from 1.4 to 2.6%. With the presence of silicon in the indicated amounts, carbide formation can be prevented so that the carbon is available for stabilizing the austenite. Due to its high oxygen affinity silicon can be used as deoxidizing agent and therefore mostly is present in killed steel alloys. Preferably, silicon is present in an amount in the range from 1.7 to 2.4% and further preferably the silicon amount is 1.9-2.2%.

The above mentioned task is further solved by a method of manufacturing the tube product with the features of claim 12. Preferred embodiments of the method can be derived from the dependent claims as well as the present description and the figures.

Accordingly, a method of manufacturing a tube product according to the invention, namely PerfGun hollow carrier, is suggested. The method is characterized in that the method comprises a quenching step and a partitioning step, wherein the quenching step has an active cooling phase and optionally a subsequent passive cooling phase.

Advantages and features, which have been described with respect to the tube product, are correspondingly valid—as far as applicable—to the inventive method and will therefore possibly only be described once.

First, austenitising takes place before the quenching and partitioning steps. Therein, an inductive heating is preferably performed, so that the tube product can be heated very fast to the target temperature, whereby in combination with the inventive alloy, in particular the previously defined preferred niobium portion, only a small harmful grain growth of the austenite occurs. Alternatively, rapid heating methods such as resistance heating or contact heating are applicable.

The quenching step will hereinafter also be referred to as quenching-step. The partitioning step will also be referred to as partitioning-step.

With this heat treatment, the retained austenite, which with the inventive alloy is formed in large amounts, can be stabilized and thereby the desired product properties can precisely be set.

With the Q&P heat treatment a two-phase microstructure, which essentially consists of low carbon martensite and retained austenite, can be formed.

During the quenching step, the steel initially is completely austenitised, that means is heated to a temperature higher than the Ac3 temperature of the steel alloy and is then quenched to a temperature, which lies between the martensite start temperature and the martensite end temperature. Thus a part of the austenite is transformed into martensite. Due to the suppressed iron carbide precipitation (cementite precipitation) the carbon diffuses during the subsequent partitioning step from the supersaturated martensite to the retained austenite. Carbon stabilizes the austenite, whereby the martensite start temperature of the carbon enriched austenite is lowered locally below room temperature. Therefore, during final quenching to room temperature no high carbon containing martensite is formed and carbon enriched austenite remains. The martensite, which is preferably tempered, increases the strength and the retained austenite ensures by the so called transformation induced plasticity effect (TRIP effect) continuously good elongation properties.

According to the invention, quenching is optionally carried out in two phases. This embodiment is in particular preferred for a manufacturing route, where the tube product is made from a bloom. In the first cooling phase the bloom is preferably cooled at a cooling rate, which is higher than the critical cooling velocity of the alloy, to a temperature T1. Herein, T1 is the martensite start temperature (Ms temperature) and Ms+/−100° C. In the second, passive cooling phase the bloom is cooled at a lower cooling velocity, in particular in air, to a temperature T2. This means, that in the passive cooling phase the bloom is cooled via natural convection in air. Depending on the wall thickness, the outer diameter and the manufacturing, the duration of the second cooling phase, for example, can be in the range from 60 s to 10 min. The temperature T2 is between 150° C. and the martensite start temperature (Ms). The specific temperature T2 depends on the carbon content of the alloy, of which the tube product consists. The lower the carbon content, the higher the temperature T2 in the preferred range between 150° C. and Ms is chosen. By the second, passive cooling phase an even temperature distribution in the tube wall is achieved compared to a single step only active cooling, whereby according to the invention a low scattering of the yield strength, breaking elongation, notch impact strength as well as of the retained austenite over the tube wall is achieved. The retained austenite portion and its scattering over the tube wall, respectively, can be precisely determined, for example by means of synchrotron in known manner.

In one embodiment in a 15 millimeter thick tube product according to the invention an austenite portion of 10 percent was determined at the tube outside at a measuring point close to the surface in a depth of 1 mm and in a depth of 4 mm an austenite portion of 20%. Therefrom a scattering of the retained austenite portion by a factor of approximately 2 over the tube wall thickness is deduced. In contrast thereto, with a faster, exclusively active cooling an inhomogeneous wall temperature distribution and close to the surface at the outer side a content of retained austenite of less than 10 percent would be present.

According to an alternative embodiment, the tube product is cooled in the active cooling phase at a cooling rate which is higher than the critical cooling velocity to a temperature T1, which is between the martensite start temperature and the martensite start temperature minus 150° C. In this embodiment, the second, passive cooling step is omitted. This embodiment is in particular advantageous for the manufacturing route for readily cut hollow carriers. In the partitioning step, the tube product or the bloom is heated to a temperature T3, which is higher than the martensite start temperature of the steel alloy and is preferably lower than 500° C. and is held at this temperature. The duration of the heating and holding is preferably in the range between 30 s and 1200 s. The minimal duration is determined by the technology, which is used for heating and delivers a minimal but still sufficient partitioning effect. Upon reaching the maximal duration no positive influence is achieved on the partitioning and in addition holding at a temperature for too long results in high costs and is thus no longer economical.

The heat treatment, in particular the step of partitioning according to the invention is preferably carried out with inductive heating. Thereby, the desired heating rates and holding phases can be set in a targeted manner. After the partitioning, the tube product can be cooled at air or actively to room temperature.

BRIEF DESCRIPTION OF THE DRAWINGS

One embodiment of the invention is described in more detail by the following description of the figures. Therein.

DETAILED DESCRIPTION OF THE PREFERRED EMBODIMENTS

Figure 1:
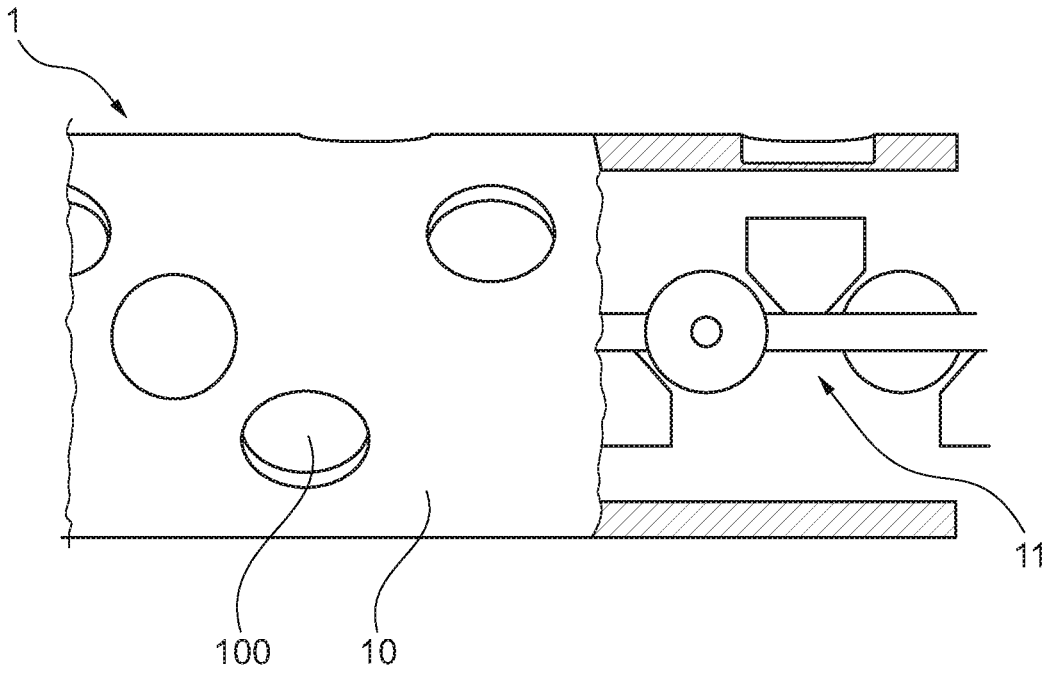
FIG. 1: shows a schematic depiction of a steel tube product in one embodiment as hollow carrier of a perforating gun.

In FIG. 1, one embodiment of the steel product 1 is schematically shown, which is a perforation gun. The perforation gun 1 comprises a tube element 10, which can also be referred to as hollow carrier. The tube element 10 preferably is a seamless tube element. In the tube element 10 locally limited sections 100 with reduced wall thickness are introduced. The locally limited areas 100 each have a circular area. The areas 100 are distributed over the length of the tube element 10. In the tube element 10 an ignition unit 18 with ignition charges is inserted. By the ignition unit 11 an explosive material of the ignition charge is ignited and thereby on one hand the areas 100 of the tube element 10 are opened and on the other hand the surrounding material, for example rock, is perforated.

Figure 2:
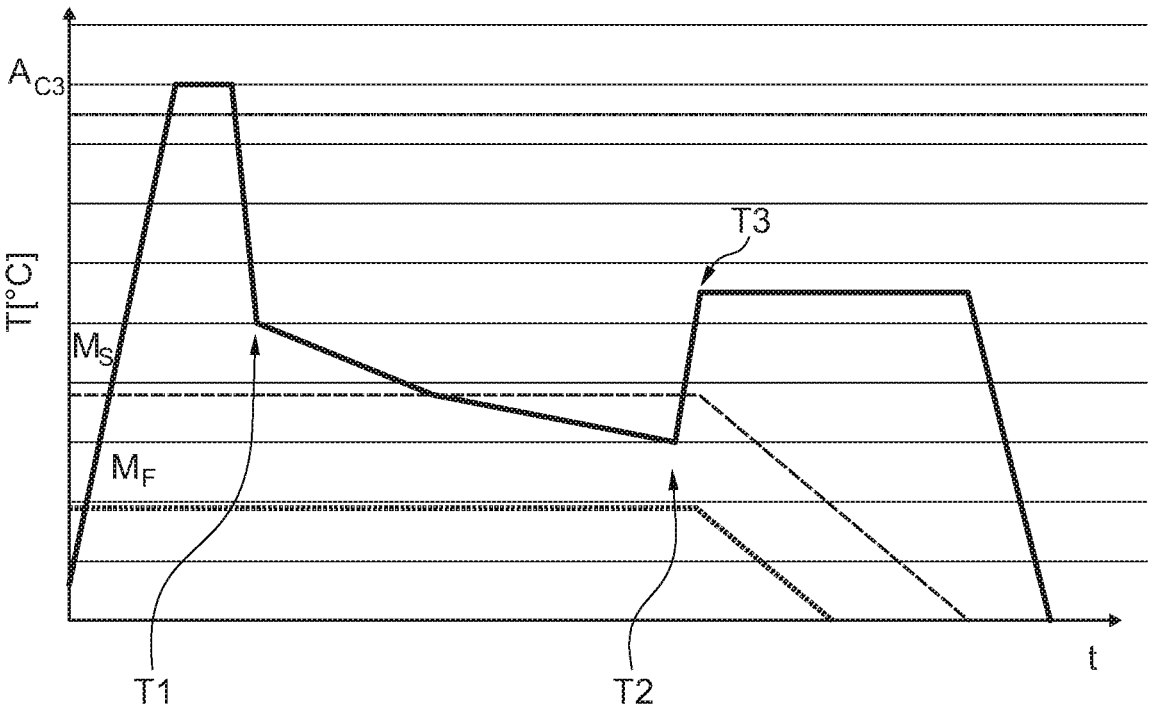
FIG. 2: shows a schematic depiction of the heat treatment according to one embodiment of the invention.

In FIG. 2 it is shown that the tube product is heated in a first step to a temperature, which is higher than the Ac3 temperature of the material of the tube product. In a first quenching step, the tube product is cooled down at a high cooling rate to a temperature T1, which in the depicted embodiment lies above the martensite start temperature, Ms. Thereby, the quenching temperature can be achieved with process reliability. In a second cooling step, the tube product is cooled by passive cooling, for example by the transport of the tube product during manufacturing to a temperature T2, which is lower than the Ms temperature. In the partitioning step subsequently the tube product is heated to a temperature T3, which is higher than the Ms temperature, and is held at this temperature.

Figure 3:
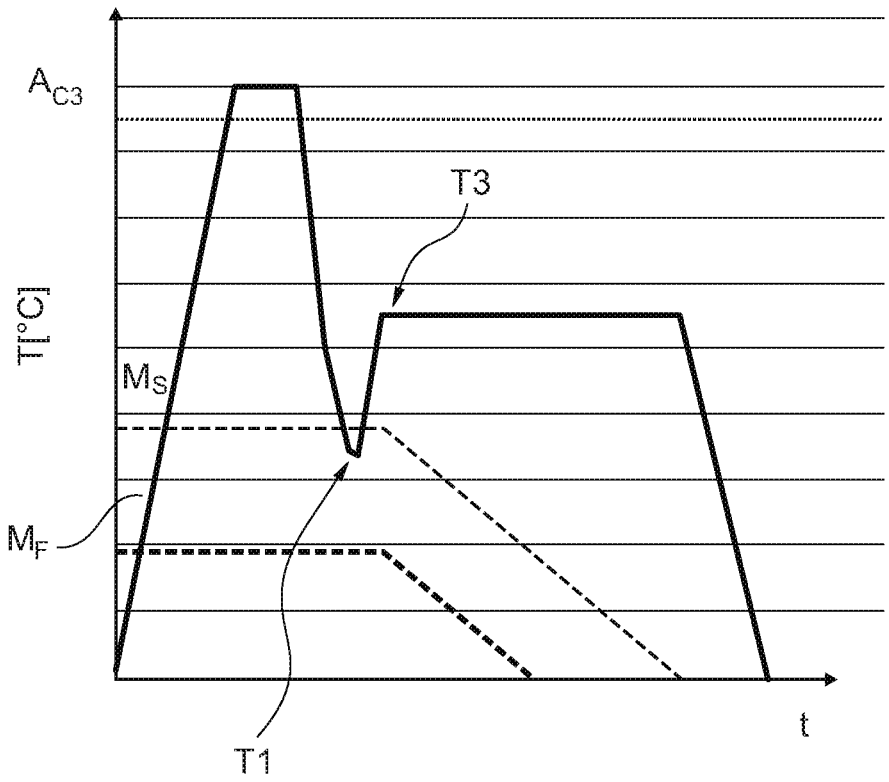
FIG. 3: shows a schematic depiction of the heat treatment according to a further embodiment of the invention.

The process in FIG. 3 differs from the embodiment of FIG. 2 in that in the embodiment in FIG. 3 the quenching step only comprise an active cooling step. Therein the tube product is cooled in the active cooling phase with a cooling rate which is higher than the critical cooling speed to a temperature T1, which is between the martensite start temperature and the martensite start temperature minus 150° C. A passive cooling step is not carried out. Instead, the tube product is immediately heated from the temperature T1 to a temperature T3, which is higher than the martensite start temperature and which is preferably lower than or equal to 500° C.

Figure 4:
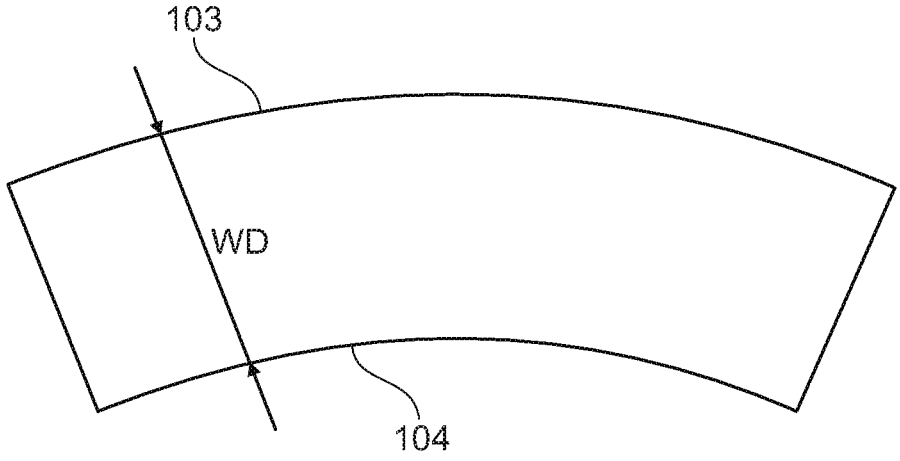
FIG. 4: shows a tube wall section of an inventive tube product according to two embodiments of the invention with associated diagram of the austenite content in the tube wall.
Figure 4:
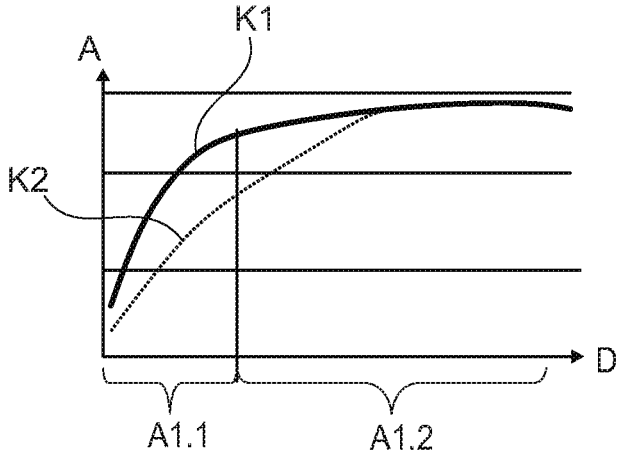

FIG. 4 shows the tube wall section of an inventive tube product with two phase cooling. The corresponding diagram shows on the horizontal axis the distance D or the measuring points, respectively, measured from the tube outer side 103, and on the vertical axis the austenite portion A. In curve K1 an overall degressively increasing austenite portion A1.1 over the tube wall from the tube outer side to the tube inner side 104 and a distinct, nearly constant austenite portion A1.2 already at less than half of the tube wall thickness WD is apparent. In comparison thereto, curve K2 shows a tube product with only one active cooling. Therein, both a comparatively lower austenite portion of the tube outer side as well as a clearly flatter increase is apparent.

Since the hollow carrier consists of the novel alloy and is manufactured by a manufacturing process with Q&P heat treatment, the hollow carrier has a higher resistance against adiabatic shearing as well as a high notch impact value. The performance of the alloy can be expressed by the ability to withstand increasing explosive amounts without being destroyed.

LIST OF REFERENCE NUMBERS

1 steel tube product
10 tube element
100 area of smaller wall thickness
103 tube outer side
104 tube inner side
11 charging unit
A austenite portion
D distance
WD wall thickness

The invention claimed is:

1. Tube product, which is a perforating gun hollow carrier, consisting of a steel alloy with a martensitic matrix, characterized in that it has a yield strength Rp0.2 of at least 900 MPa, and that the steel alloy besides iron and impurities caused by melting has the following alloying elements in mass %:

C 0.15-0.6%
Si 1.4-2.6%
Cr 2.0-4.0%
Mn 0.15% to less than 0.7%
Mo 0.2-0.6%
N<0.015% and
at least one of the alloying elements Nb, V and Ti in sum of ≥0.01%;
the tube product has been subjected to a quenching and partitioning heat treatment;
the tube product has a microstructure of martensite and austenite, wherein the portion of austenite is within the range from 5 to 20%; and
the austenite portion has a degressively increasing course over the thickness of the tube wall from a tube outer side to a tube inner side.

2. Tube product according to claim 1, characterized in that the silicon content is in the range from 1.7 to 2.4%.

3. Tube product according to claim 1, characterized in that the chromium content is in the range from 2.5 to 3.5%.

4. Tube product according to claim 1, characterized in that at least one of the following alloying elements is present in the indicated amounts in the steel alloy:

Nb 0.001-0.1%
V 0.025-0.5%
Ti 0.015 to 0.1%
Al 0.01-0.1%.

5. Tube product according to claim 4 wherein Nb is present in the following amount in the steel alloy:

Nb 0.015-0.05%.

6. Tube product according to claim 4 wherein Al is present in the following amount in the steel alloy:

Al 0.015-0.06%.

7. Tube product according to claim 1, characterized in that the steel alloy has nickel in an amount of maximum 3%.

8. Tube product according to claim 1, characterized in that the steel alloy has boron in an amount in the range of 0.001-0.004%.

9. Tube product according to claim 1, characterized in that the amount of austenite in the microstructure, determined in 1 mm depth, measured from the tube outer surface, is more than 5%.

10. Tube product according to claim 1, characterized in that the microstructure has bainite, ferrite and/or perlite in an overall amount of less than 10%.

11. Tube product according to claim 1, characterized in that the tube product has an energy absorption capacity expressed by a product of tensile strength, Rm, and a breaking elongation, A, which is determined at a round sample with an elongation measurement length of 20 mm, of at least 18,000 MPa %.

12. Tube product according to claim 1, characterized in that the tube product has a notch impact strength of at least 4 J at 20° C., which is determined on a mini sample 3×4 mm.

13. Tube product according to claim 1, characterized in that the yield strength Rp0.2 is at least 1,050 MPa.

14. Tube product according to claim 1, characterized in that the silicon content is in the range from 1.8 to 2.2%.

15. Tube product according to claim 1, characterized in that the chromium content is in the range from 2.7 to 3.2%.

16. Tube product according to claim 1, characterized in that the tube product has a microstructure of martensite and austenite, wherein the portion of austenite is within the range from 5% to less than 15%.

17. Tube product according to claim 1, characterized in that the amount of austenite in the microstructure, determined in 1 mm depth, measured from the tube outer surface, is at least 10%.

18. Tube product according to claim 1, characterized in that the microstructure has bainite, ferrite and/or perlite in an overall amount of less than 5%.

* * * * *